United States Patent [19]

Romblom

[11] 4,387,693

[45] Jun. 14, 1983

[54] EXHAUST GAS RECIRCULATION CONTROL

[75] Inventor: Edward R. Romblom, DeWitt, Mich.

[73] Assignee: General Motors Corporation, Detroit, Mich.

[21] Appl. No.: 322,527

[22] Filed: Nov. 18, 1981

[51] Int. Cl.[3] ..... F02M 25/06

[52] U.S. Cl. ..... 123/569; 123/568

[58] Field of Search ..... 123/569, 571, 568

[56] References Cited

U.S. PATENT DOCUMENTS

| | | | |
|---|---|---|---|
| 2,456,213 | 12/1948 | Pelc | 123/569 |
| 3,545,472 | 12/1970 | Franz | 137/116.5 |
| 4,080,941 | 3/1978 | Bertrand | 123/568 |
| 4,142,499 | 3/1979 | Salzgeber | 123/339 |
| 4,190,031 | 2/1980 | Sigwald et al. | 123/568 |
| 4,206,730 | 6/1980 | Cobb | 123/569 |
| 4,269,159 | 5/1981 | Skinner | 123/569 |

FOREIGN PATENT DOCUMENTS

| | | | |
|---|---|---|---|
| 2946557 | 11/1977 | Fed. Rep. of Germany | 123/569 |

OTHER PUBLICATIONS

1980 Buick Chassis Service Manual, p. 6A5-53.
1981 Buick Chassis Service Manual, pp. 6-2, 6-3.

*Primary Examiner*—Wendell E. Burns
*Attorney, Agent, or Firm*—C. K. Veenstra

[57] ABSTRACT

An exhaust gas recirculation control assembly senses a throttle position related vacuum signal, an engine speed related pressure, and atmospheric pressure to create a subatmospheric control pressure suitable for actuating a diaphragm operated exhaust gas recirculation control valve.

4 Claims, 3 Drawing Figures

EXHAUST GAS RECIRCULATION CONTROL

TECHNICAL FIELD

This invention relates to exhaust gas recirculation control and provides an assembly for controlling exhaust gas recirculation in a diesel engine in accordance with throttle position and engine speed.

BACKGROUND

Recirculation of exhaust gases has been employed to inhibit the formation and emission of oxides of nitrogen from internal combustion engines. For diesel engines, it has been proposed to vary recirculation of exhaust gases in accordance with throttle position and engine speed—increasing recirculation as the throttle reduces fuel flow, and increasing recirculation with engine speed. A vacuum regulator valve has been employed to create a vacuum signal which varies with throttle position, and a diaphragm operated exhaust gas recirculation valve has controlled recirculation in accordance with such a throttle position related vacuum signal. However, systems responsive to both throttle position and engine speed have heretofore required electronic control circuitry.

SUMMARY OF THE INVENTION

This invention provides an exhaust gas recirculation (EGR) control assembly which senses both a throttle position related pressure and an engine speed related pressure and creates a control pressure suitable for actuating a diaphragm operated EGR valve to control EGR in response to both throttle position and engine speed.

In the preferred embodiment of this EGR control assembly set forth below, a spring biased diaphragm assembly balances the control pressure against a throttle position related pressure and operates a valve assembly to vary the control pressure in proportion to but offset from the throttle position related pressure. Another pressure responsive member senses an engine speed related pressure and adjusts the spring bias to vary the offset of the control pressure from the throttle position related pressure with engine speed.

The details as well as other features and advantages of this invention are set forth in the remainder of the specification and are shown in the accompanying drawings.

BEST MODE FOR CARRYING OUT THE INVENTION

Figure 1:
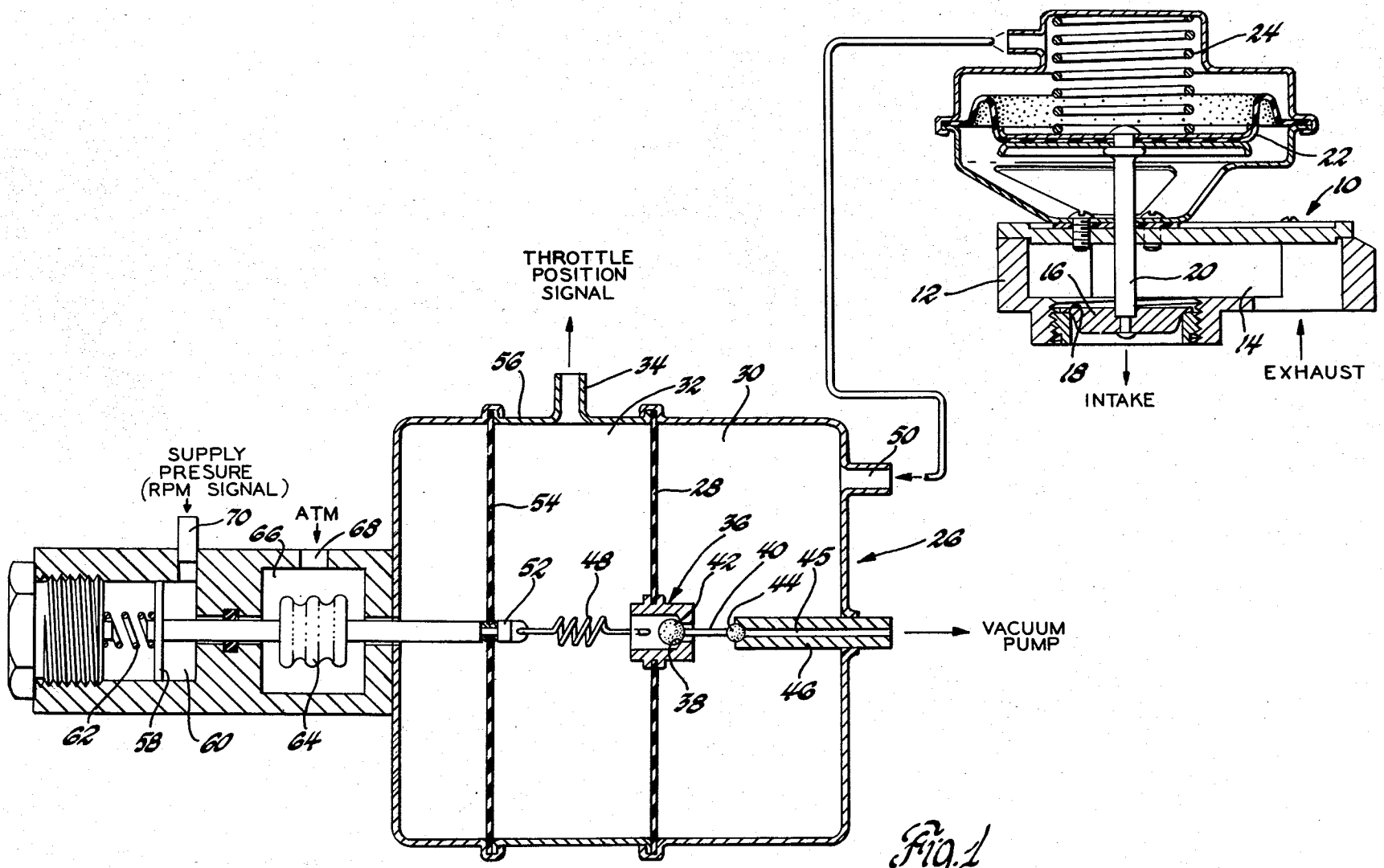
FIG. 1 is a schematic view of this exhaust gas recirculation control assembly connected to an EGR valve.

Referring first to FIG. 1, a diesel engine has an EGR valve assembly 10, the body 12 of which defines a passage 14 for recirculating exhaust gases from the engine exhaust system to the engine induction system. Within passage 14, a valve pintle 16 may be lifted away from a valve seat 18 to increase recirculation of exhaust gases. Valve pintle 16 is secured to a valve stem 20 operated by an operating diaphragm 22 and is biased to the closed position shown by a spring 24. Operating diaphragm 22 responds to variations in a subatmospheric control pressure created by a control assembly 26 to position valve pintle 16 and thus control recirculation of exhaust gases.

Within control assembly 26, a diaphragm assembly 28 separates a control pressure chamber 30 from a chamber 32 having a fitting 34 adapted to sense a subatmospheric pressure which varies with throttle position. Diaphragm assembly 28 carries a valve mechanism 36 including a vent orifice 38 opening through diaphragm assembly 28, and a double ended valve member 40 having a valve element 42 adapted to close vent orifice 38 and a valve element 44 adapted to close a supply orifice 45 in a fitting 46 connected to a vacuum pump. A spring 48 biases diaphragm assembly 28 leftwardly as shown in FIG. 1. When the force on the right-hand face of diaphragm assembly 28 created by the control pressure in chamber 30, together with the force of spring 48, exceeds the force created on the left-hand face of diaphragm assembly 28 by the throttle position related pressure in chamber 32, diaphragm assembly 28 moves leftwardly, seating valve element 42 across vent orifice 38 and displacing valve element 44 from vacuum fitting 46; the vacuum pump then reduces the control pressure in chamber 30. When the throttle position related pressure in chamber 32 creates a force on diaphragm assembly 28 exceeding the force created by the control pressure in chamber 30 and the force of spring 48, diaphragm assembly 28 moves rightwardly, seating valve element 44 in vacuum fitting 46 and displacing vent orifice 38 from valve element 42; the pressure in chamber 32 then increases the control pressure in chamber 30.

The control pressure in chamber 30 is thereby maintained proportional to the throttle position related pressure in chamber 32 and is offset by an amount determined by the force of spring 48. An outlet fitting 50 is adapted to transmit the control pressure from chamber 30 to EGR valve assembly 10 so that operating diaphragm 22 can position valve pintle 16 to control recirculation of exhaust gases in accordance with the throttle position related pressure.

The left-hand end of spring 48 is connected to a link 52, and a diaphragm 54 seals link 52 to the housing 56 of control assembly 26 to close off chamber 32. Link 52 extends from spring 48 to a pressure responsive piston 58. Piston 58 defines a portion of a chamber 60 adapted to sense a pressure which varies with engine speed. As the pressure in chamber 60 increases with engine speed, piston 58 moves leftwardly against the bias of a spring 62, thereby increasing the force of spring 48. As the pressure in chamber 60 drops with engine speed, spring 62 moves piston 58 and link 52 rightwardly to reduce the force of spring 48. Thus it will be appreciated that as engine speed and the pressure in chamber 60 increase, the force of spring 48 increases and the control pressure drops (the vacuum signal to EGR assembly 10 increases) to increase EGR.

Link 52 includes an aneroid 64 disposed in a chamber 66 having an aperture 68 so that aneroid 64 senses the ambient atmospheric pressure. As atmospheric pressure decreases, aneroid 64 expands, displacing the right-hand end of link 52 rightwardly to decrease the force of spring 48. As atmospheric pressure increases, aneroid 64 contracts to displace the right-hand end of link 52 leftwardly and increase the force of spring 48. Thus as atmospheric pressure decreases and the force of spring 48 decreases, the control pressure increases (the vacuum signal to EGR valve assembly 10 decreases) to decrease EGR.

Figure 2:
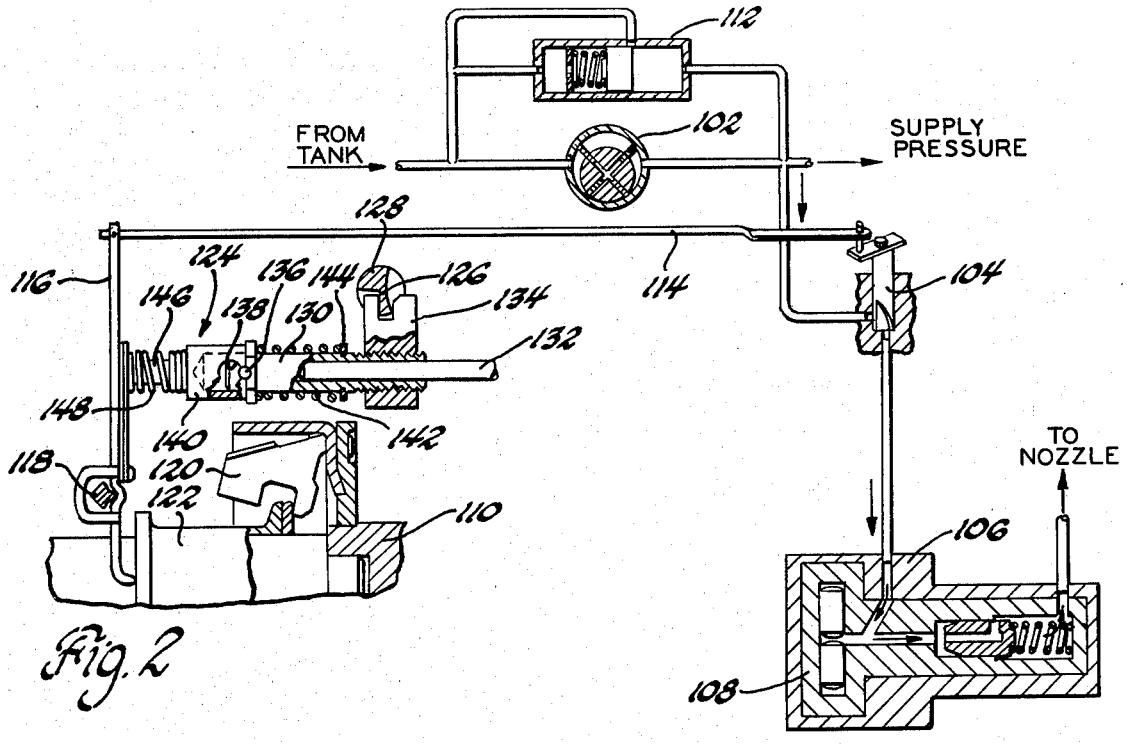
FIG. 2 is a schematic view of a diesel injection pump showing the transfer pump which creates a pressure related to engine speed and also showing the throttle shaft and its connection to the fuel metering valve.

FIG. 2 shows a well known diesel fuel injection pump assembly which has a transfer pump 102 to supply fuel from a fuel tank past a metering valve 104 to the head 106 of an injection pump 108. Transfer pump 102, along with injection pump 108 and a governor assembly 110, are driven by the engine. Transfer pump 102 has a regulator 112 which assures that the outlet or supply pressure from transfer pump 102 increases with engine speed. Thus the supply pressure created by transfer pump 102 may be supplied through fitting 70 to chamber 60 in control assembly 26 to provide the engine speed related pressure in chamber 60.

Metering valve 104 is positioned by a link 114 connected to a governor plate 116 pivoted at 118. Weights 120 provide a bias on a sleeve 122 which increases with engine speed tending to pivot governor plate 116 clockwise about pivot 118. Governor plate 116 is urged in the opposite direction by a governor spring assembly 124, the axial position of which is adjustable by a cam 126 formed on a throttle shaft 128. Throttle shaft 128 is connected through linkage not shown to the operator's control, such as the accelerator pedal in an automobile. The governor spring assembly 124 includes a hollow push rod 130 which slides on a stationary guide stud 132. A throttle block 134 is threaded on push rod 130 and is bifurcated at its upper end to straddle throttle cam 126. Throttle block 134 and push rod 130 thus reciprocate on guide stud 132 as throttle shaft 128 is rotated. Push rod 130 has a radially projecting pin 136 received in an aperture 138 of a sleeve 140 mounted on push rod 130. A spring 142 surrounds push rod 130 and is compressed between sleeve 140 and a retaining washer 144 mounted on push rod 130. Sleeve 140 has a projection 146 supporting a spring 148 between sleeve 140 and governor plate 116.

As throttle shaft 128 is rotated in a clockwise direction to command an increased engine speed, throttle cam 126 moves block 134 and push rod 130 leftwardly, and spring 142 urges sleeve 140 leftwardly; sleeve 140 in turn causes spring 148 to urge governor plate 116 in a counterclockwise direction to open metering valve 104. Then as the engine speed increases, weights 120 urge sleeve 122 leftwardly to bias governor plate 116 in a clockwise direction tending to close metering valve 104. Governor assembly 110 thereby controls the position of metering valve 104 to provide the engine speed commanded by throttle shaft 128.

Figure 3:
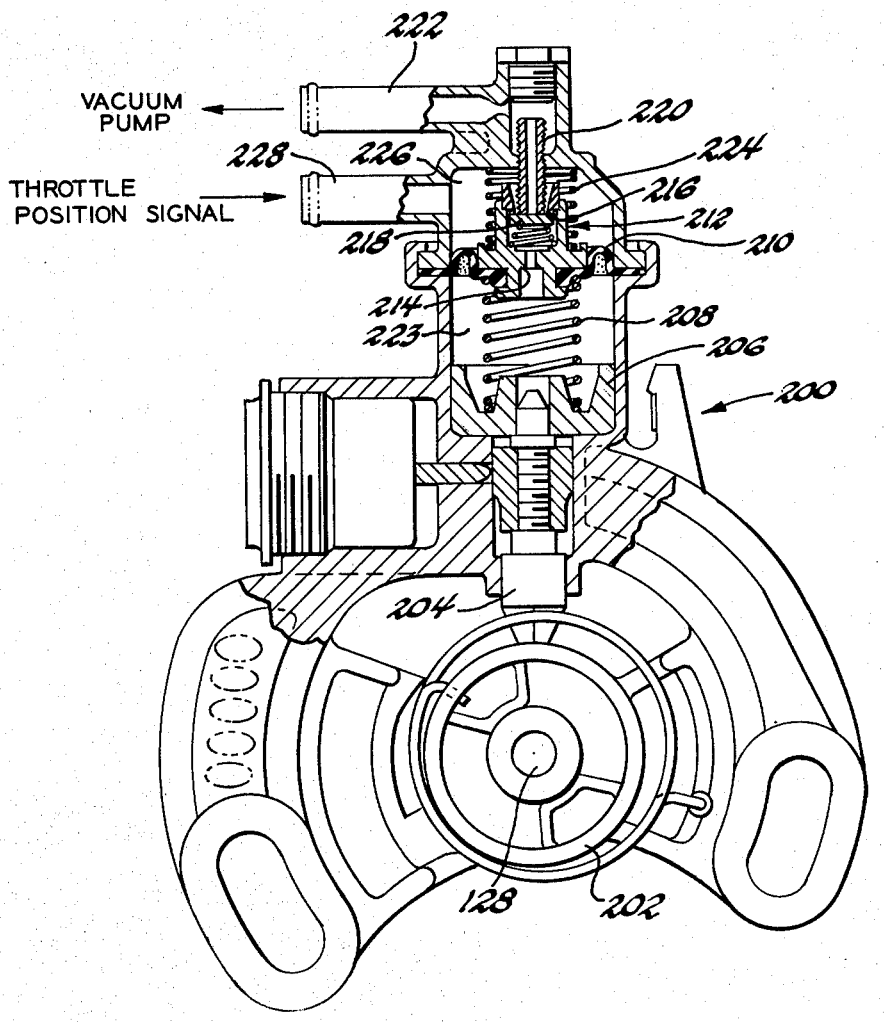
FIG. 3 is a sectional view of a vacuum regulator valve which creates a vacuum signal related to throttle position.

FIG. 3 shows a vacuum regulator valve assembly 200 which may be employed to supply the throttle position related pressure signal. Assembly 200 includes a cam ring 202 secured on the injection pump throttle shaft 128. As throttle shaft 128 and cam ring 202 rotate, cam ring 202 lifts a plunger 204 and a spring seat 206 secured on plunger 204. Spring seat 206 then compresses a spring 208 to increase the upward force on a diaphragm assembly 210. Diaphragm assembly 210 carries a valve assembly 212 which includes an atmospheric bleed 214, a valve seat 216 and a valve disc 218 associated with valve seat 216. Valve disc 218 is also associated with the end of a tube 220 connected to a fitting 222 which is connected to the vacuum pump.

Diaphragm assembly 210 is biased upwardly by spring 208 and by atmospheric pressure in a chamber 223 below diaphragm assembly 210 and is biased downwardly by a spring 224 and by the subatmospheric pressure in a chamber 226 above diaphragm assembly 210. When the downward force created by the pressure in chamber 226 and the force of spring 224 exceeds the upward force created by atmospheric pressure in chamber 223 and the force of spring 208, diaphragm assembly 210 is displaced downwardly, and valve seat 216 displaces valve disc 218 from the end of tube 220. The pressure in chamber 226 is then reduced by the vacuum pump. When the upward force on diaphragm assembly 210 created by atmospheric pressure in chamber 223 and the force of spring 208 exceeds the downward force on diaphragm assembly 210 created by the pressure in chamber 226 and the force of spring 224, diaphragm assembly 210 moves upwardly and tube 220 disengages valve disc 218 from valve seat 216. The atmospheric pressure sensed through bleed 214 then increases the pressure in chamber 226.

Accordingly as the force of spring 208 is increased by throttle opening movement of cam ring 202, the pressure in chamber 226 is increased and the vacuum signal is decreased. Accordingly, the pressure in chamber 226 varies directly (the vacuum signal varies inversely) with throttle opening movement. Thus the pressure in chamber 226 may be directed through fitting 228 to fitting 34 of control assembly 26.

The embodiments of the invention in which an exclusive property or privilege is claimed are defined as follows:

1. An exhaust gas recirculation control assembly for a diesel engine having a throttle member controlling fuel flow to the engine, means for generating a pressure which varies with the position of said throttle member, means for generating a pressure which varies with engine speed, and a diaphragm operated valve controlling recirculation of exhaust gases in response to variations in a control pressure, said assembly comprising a diaphragm assembly including a first diaphragm portion sensing said control pressure and a second diaphragm portion sensing said throttle position related pressure, a valve mechanism connected to said diaphragm assembly for varying said control pressure in proportion to said throttle position related pressure, a spring biasing said valve mechanism to maintain said control pressure offset from said throttle position related pressure, and a pressure responsive member connected to said spring and responsive to said speed related pressure for increasing the bias to thereby increase the offset of said control pressure as engine speed increases.

2. An exhaust gas recirculation control assembly for a diesel engine having a throttle member controlling fuel flow to the engine, means for generating a pressure which varies with the position of said throttle member, means for generating a pressure which varies with engine speed, and a diaphragm operated valve controlling recirculation of exhaust gases in response to variations in a control pressure, said assembly comprising a diaphragm assembly including a first diaphragm portion sensing said control pressure and a second diaphragm portion sensing said throttle position related pressure, a valve mechanism connected to said diaphragm assembly for varying said control pressure in proportion to said throttle position related pressure, a spring biasing said valve mechanism to maintain said control pressure offset from said throttle position related pressure, a pressure responsive member connected to said spring and responsive to said speed related pressure for increasing the bias to thereby increase the offset of said control pressure as engine speed increases, and an additional pressure responsive member connected to said spring and responsive to atmospheric pressure for decreasing the bias to thereby decrease the offset of said control pressure as atmospheric pressure decreases.

3. An exhaust gas recirculation control assembly for a diesel engine having a throttle member controlling fuel flow to the engine, means for generating a subatmospheric pressure which varies with the position of said throttle member, means for generating a superatmospheric pressure which varies with engine speed, and a diaphragm operated valve controlling recirculation of exhaust gases in response to variations in a subatmospheric control pressure, said assembly comprising a diaphragm assembly including a first diaphragm portion defining a portion of a control pressure chamber having an outlet adapted to transmit said control pressure to said diaphragm operated valve, said diaphragm assembly further including a second diaphragm portion defining a portion of a second chamber having a connection adapted to sense said throttle position related pressure, the control pressure in said control pressure chamber and the throttle position related pressure in said second chamber creating oppositely directed forces on said diaphragm assembly, a spring having an end connected to said diaphragm assembly for exerting a biasing force on said diaphragm assembly in opposition to the force exerted on said diaphragm assembly by said throttle position related pressure, said control pressure chamber having a supply orifice adapted for connection to a source of subatmospheric pressure, a valve mechanism including a vent orifice formed by a portion of said diaphragm assembly and a valve member position by said diaphragm assembly to control said orifices, said valve member being displaced from said supply orifice to reduce said control pressure when the force created on said diaphragm assembly by said control pressure and said spring exceeds the force created on said diaphragm assembly by said throttle position related pressure, said valve member being displaced from said vent orifice to increase said control pressure when the force created on said diaphragm assembly by said throttle position related pressure exceeds the force created on said diaphragm assembly by said control pressure and said spring, whereby said control pressure is maintained proportional to and offset from said throttle position related pressure, and a pressure responsive member defining a portion of a chamber having a connection adapted to sense said speed related pressure, said pressure responsive member having a link connected to the opposite end of said spring for increasing the force exerted by said spring on said diaphragm assembly as said speed related pressure increases to thereby increase the offset of said control pressure from said throttle position related pressure.

4. An exhaust gas recirculation control assembly for a diesel engine having a throttle member controlling fuel flow to the engine, means for generating a subatmospheric pressure which varies with the position of said throttle member, means for generating a superatmospheric pressure which varies with engine speed, and a diaphragm operated valve controlling recirculation of exhaust gases in response to variations in a subatmospheric control pressure, said assembly comprising a diaphragm assembly including a first diaphragm portion defining a portion of a control pressure chamber having an outlet adapted to transmit said control pressure to said diaphragm operated valve, said diaphragm assembly further including a second diaphragm portion defining a portion of a second chamber having a connection adapted to sense said throttle position related pressure, the control pressure in said control pressure chamber and the throttle position related pressure in said second chamber creating oppositely directed forces on said diaphragm assembly, a spring having an end connected to said diaphragm assembly for exerting a biasing force on said diaphragm assembly in opposition to the force exerted on said diaphragm assembly by said throttle position related pressure, said control pressure chamber having a supply orifice adapted for connection to a source of subatmospheric pressure, a valve mechanism including a vent orifice formed by a portion of said diaphragm assembly and a valve member positioned by said diaphragm assembly to control said orifices, said valve member being displaced from said supply orifice to reduce said control pressure when the force created on said diaphragm assembly by said control pressure and said spring exceeds the force created on said diaphragm assembly by said throttle position related pressure, said valve member being displaced from said vent orifice to increase said control pressure when the force created on said diaphragm assembly by said throttle position related pressure exceeds the force created on said diaphragm assembly by said control pressure and said spring, whereby said control pressure is maintained proportional to and offset from said throttle position related pressure, a pressure responsive member defining a portion of a chamber having a connection adapted to sense said speed related pressure, said pressure responsive member having a link connected to the opposite end of said spring for increasing the force exerted by said spring on said diaphragm assembly as said speed related pressure increases to thereby increase the offset of said control pressure from said throttle position related pressure, and an aneroid responsive to atmospheric pressure forming a portion of said link for increasing the length of said link as atmospheric pressure decreases to thereby reduce the biasing force exerted by said spring on said diaphragm assembly and accordingly decrease the offset of said control pressure from said throttle position related pressure.

* * * * *